US005893934A

United States Patent [19]

Lee

[11] Patent Number: 5,893,934

[45] Date of Patent: Apr. 13, 1999

[54] DEWATERING METHOD FOR AUTOMATIC WASHING MACHINE

[75] Inventor: Dong Geun Lee, Kyungsangnam-do, Rep. of Korea

[73] Assignee: LG Electronics Inc., Seoul, Rep. of Korea

[21] Appl. No.: 08/936,195

[22] Filed: Sep. 23, 1997

Related U.S. Application Data

[62] Division of application No. 08/741,225, Oct. 29, 1996.

[30] Foreign Application Priority Data

Feb. 22, 1996 [KR] Rep. of Korea ..... 96-4164

[51] Int. Cl.[6] ..... D06F 33/02

[52] U.S. Cl. ..... 8/159

[58] Field of Search ..... 68/12.06, 12.26; 210/144, 146; 292/DIG. 69; 192/136; 8/159

[56] References Cited

U.S. PATENT DOCUMENTS

| | | | |
|---|---|---|---|
| 3,226,959 | 1/1966 | Smith et al. | 68/12.06 |
| 3,504,777 | 4/1970 | Waugh | 68/12.26 X |
| 3,762,552 | 10/1973 | Landwier | 210/146 |
| 4,449,383 | 5/1984 | Cartier | 68/12.06 |
| 5,038,587 | 8/1991 | Harmelink | 68/12.06 X |
| 5,050,407 | 9/1991 | Wild | 68/12.06 |
| 5,375,437 | 12/1994 | Dausch et al. | 68/12.06 |

FOREIGN PATENT DOCUMENTS

| | | | |
|---|---|---|---|
| 179093 | 9/1985 | Japan | 292/DIG. 69 |

*Primary Examiner*—Philip R. Coe

[57] ABSTRACT

A dehydrating apparatus of an automatic washing machine includes: an unbalance sensor mounted on a controller mounted into a top cover, for sensing an unbalance of a washing tub during performing a dehydrating function; a magnet mounted on a door, for sensing an opening of the door during performing the dehydrating function; and a hall sensor mounted on an another controller more adjacent to the magnet, for sensing switch on or off state by means of a magnetic field of the magnet in the event of opening or closing of the door. To sense the unbalance of the washing tub for a certain time after performing the dehydrating cycle, sensing time of the unbalance is counted from starting time of the dehydrating function to compare with a certain time. If the sensing time of the unbalance is more than a certain time, a sub-routine for sensing the unbalance. If not, the sensing time of the unbalance is accumulatively counted and stored into a memory, to determine the dehydrating cycle time. Thus, the unbalance of the washing tub and the opening of the door can exactly be sensed to control them.

10 Claims, 10 Drawing Sheets

DEWATERING METHOD FOR AUTOMATIC WASHING MACHINE

This application is a divisional of copending application Ser. No. 08/741,225, filed on Oct. 29, 1996, the entire contents of which are hereby incorporated by reference.

BACKGROUND OF THE INVENTION

1. Field of the Invention

The present invention relates to a dewatering apparatus of an automatic washing machine and a control method thereof, and more particularly, to a dewatering apparatus and the control method thereof in which an unbalance of a washing tub and an opening of a door can be accurately sensed to control them while performing a dewatering function after completing wash and rinse cycles in the washing machine.

2. Discussion of the Related Art

A conventional automatic washing machine is shown in FIG. 1 to FIG. 4. Since unbalance sensing switch 4*a* is mounted at one side of a top cover 1*a* on a body 16, switching points 24*a*,25*a* of first and second terminals 24,25 are coupled by upward movement of a door lever 22 and a switching lever 23 when a door 5*a* closes, to switch on current as shown in FIG. 2*a*.

As shown in FIG. 2*a*, if washing tub 3 oscillates during a dewatering process, the washing tub 3 bumps against an outer tub 15. At the same time, unbalance sensing lever 26 is deflected by a predetermined distance L by means of the outer tub 15. Likewise, the switching points 24*a*,25*a* of the first and second terminals 24,25 are isolated from each other by the action of switching lever 23 to switch off current as shown in FIG. 2*b*.

Laundry may lean to one side of the washing tub 3 while tub 3 spins to dewater the laundry, for dehydration after washing and rinsing. The washing tub 3 therefore becomes unbalanced thereby causing the washing tub 3 to bump against the outer tub 15. At the same time, the outer tub 15 pushes the unbalance sensing lever 26. As a result, the switching points 24*a*,25*a* of the first and second terminals 24,25 switch off for a certain time t.

Further, since the door lever 22 is not displaced when door 5*a* of the washing machine opens as shown in FIG. 2, the switching points 24*a*,25*a* of the first and second terminals 24,25 remain switched off until the door 5*a* closes.

Meanwhile, as shown in FIG. 3, a low signal is input to the microprocessor 21 when the unbalance sensing switch 4*a* is closed, while a high signal is input to the microprocessor 21 when the unbalance sensing switch 4*a* opens. Thus, when a signal having a predetermined level is input to the microprocessor 21 as shown in FIG. 4, an unbalance of the washing tub 3 is sensed when the signal input time is shorter than a certain the threshold time t of about 80–200 ms. The opening of the door 5*a* is sensed when the signal input time is longer than the threshold time.

However, since the opening of the door 5*a* and the unbalance of the washing tub 3 are simultaneously sensed by the unbalance sensing switch 4*a* as above, it is difficult to sense the opening of the door 5*a* when primarily on using the unbalance sensing switch 4*a* for sensing the unbalance of the washing tub 3. On the other hand, it is difficult to sense the unbalance of the washing tub 3 when primarily using the same for sensing the opening of the door 5*a*. In addition, the sensing performance depends on position of the unbalance sensing switch 4*a*.

Moreover, once the unbalance sensing switch is fixed to the washing machine, it is hard to change its configuration and position. If a relatively large amount of laundry is loaded into the washing tub 3, the position of the outer tub 15 is lower than a bottom portion of unbalance sensing lever 26 because of laundry's weight and a buffer force of a damper 27 mounted between a top portion of the body 16 and a bottom portion of the outer tub 15. This makes sensing the unbalance of the washing tub 3 impossible or causes deformation of the unbalance sensing lever 26 in case of its restoration as it is to occur malfunction of the sensing function of the unbalance. It is also likely for the unbalance sensing lever 26 protruding towards a lower portion of the top cover 1*a* to become deformed while transferring and assembling the top cover 1*a*, and while disassembling the machine for assembly and change of the washing machine.

SUMMARY OF THE INVENTION

Accordingly, the present invention is directed to a dewatering apparatus of an automatic washing machine and a control method thereof that substantially obviates one or more of the limitations and disadvantages of the related art.

An object of the present invention is to provide a dehydration control method of an automatic washing machine capable of performing a desirable dehydrating function by exactly sensing an unbalance of a washing tub and an opening of a door, which are caused by performing the dehydrating function under circumstances that laundry leans to one side of the washing tub after completing washing and rinse of the laundry.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dewatering apparatus of an automatic washing machine according to the present invention includes: an unbalance sensor mounted on a controller mounted into a top cover, for sensing an unbalance of a washing tub during a dewatering process; a magnet mounted on a door, for sensing an opening of the door during the dewatering process; and a hall sensor mounted on an another controller more adjacent to the magnet, for sensing the on/off state of a switch by means of the a magnetic field of the magnet in the event of opening or closing of the door.

The watering control method according to the present invention includes the steps of: initiating a variable state relating to a dewatering function and determining levels of input signals input to input ports of a microprocessor; interrupting the dewatering cycle in progress by detecting opening of a door if the level of input signals to the microprocessor are high and, at the same time, stopping a progressing state of an indicative portion indicative of the dewatering cycle in progress; continuing the dewatering cycle if the input signals are low; measuring an elapsed time between a starting time of the dewatering function and a time at which the unbalance of the washing tub is sensed for a certain time since the dehydrating function has progressed, and comparing and determining whether or not it is less than a threshold time; and performing a sub-routine which senses the unbalance of the washing tub where the sensing time of the unbalance is less than the threshold time, and determining progressing time of the dehydrating cycle after accumulatively counting the sensing time of the unbalance and storing it into a memory in case where it is more than a certain time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together will the description serve to explain the principles of the drawings.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
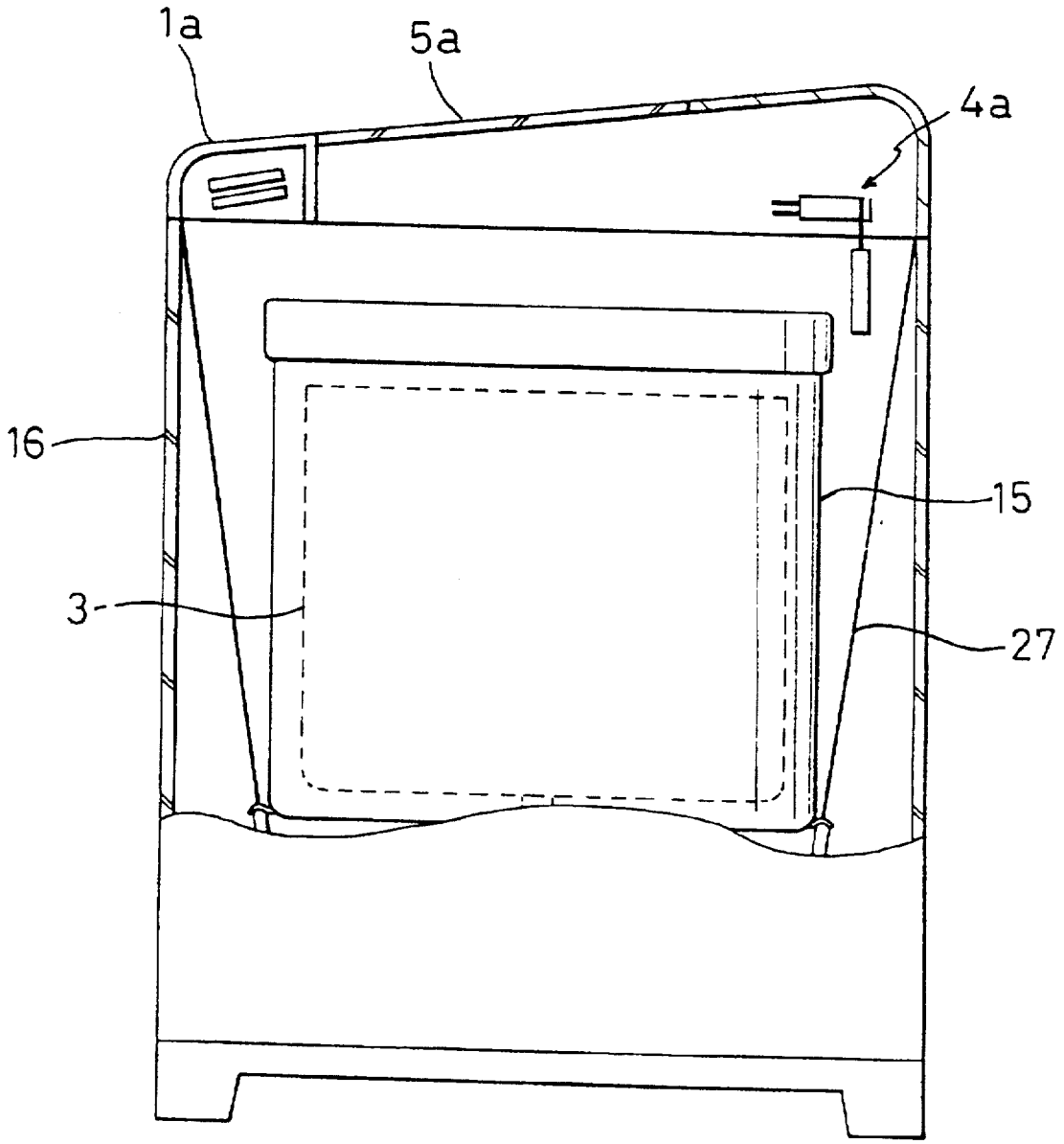
FIG. 1 prior art
FIG. 1 shows a longitudinal section of a conventional automatic washing machine.
Figure 2A:
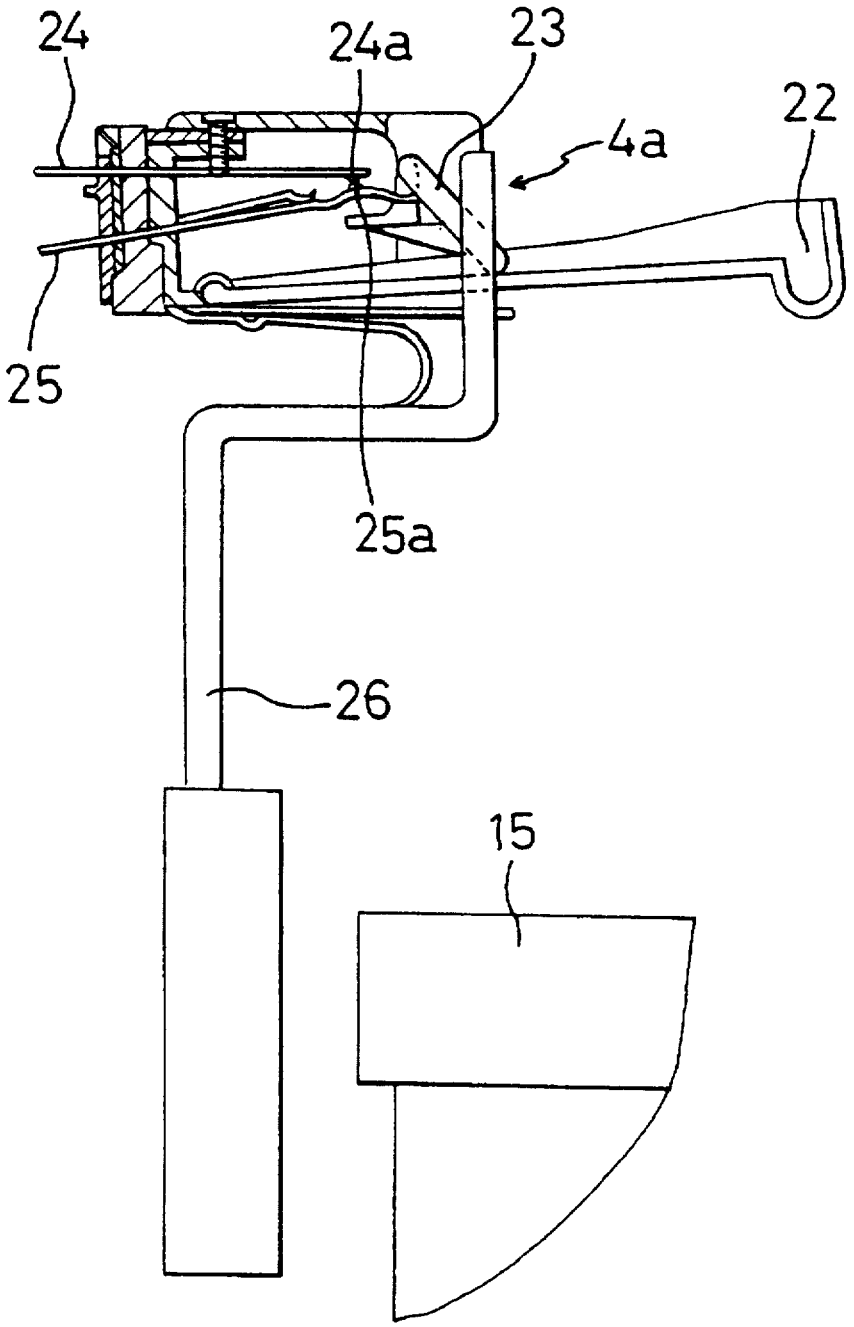
FIG.2A prior art
FIGS. 2*a* and 2*b* show longitudinal sections showing operation of an unbalance sensing switch of FIG. 1.
Figure 2B:
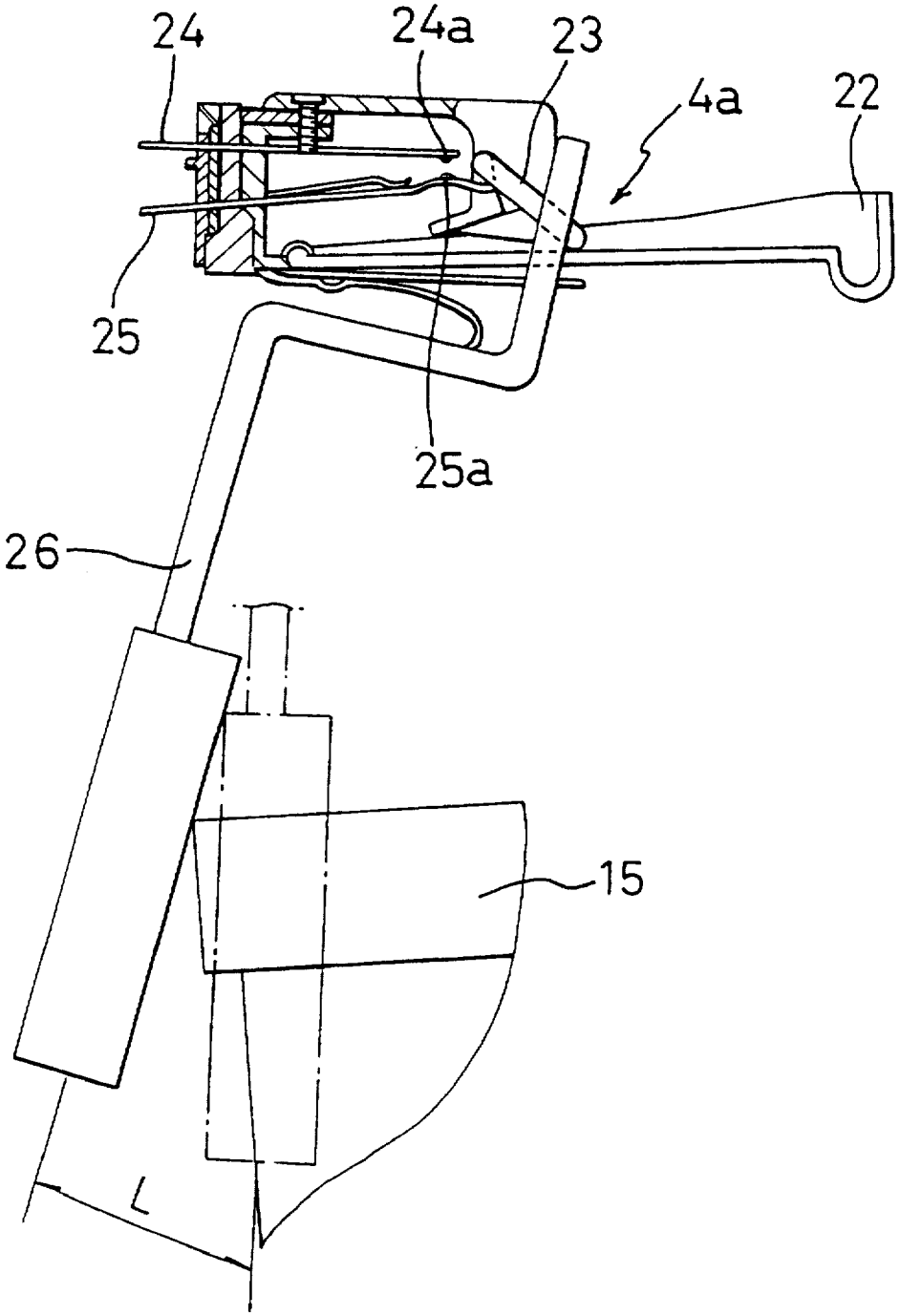
FIG.2B prior art
Figure 3:
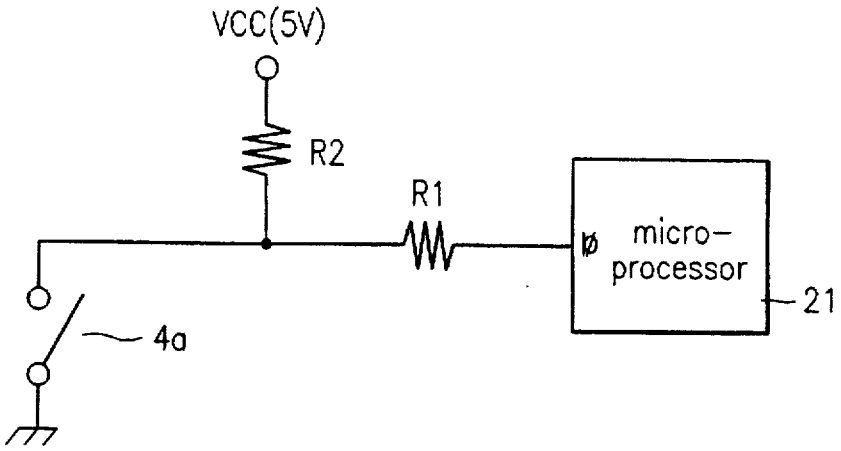
FIG.3 prior art
FIG. 3 shows an operation circuit of an unbalance sensing switch of FIG. 1.
Figure 4:
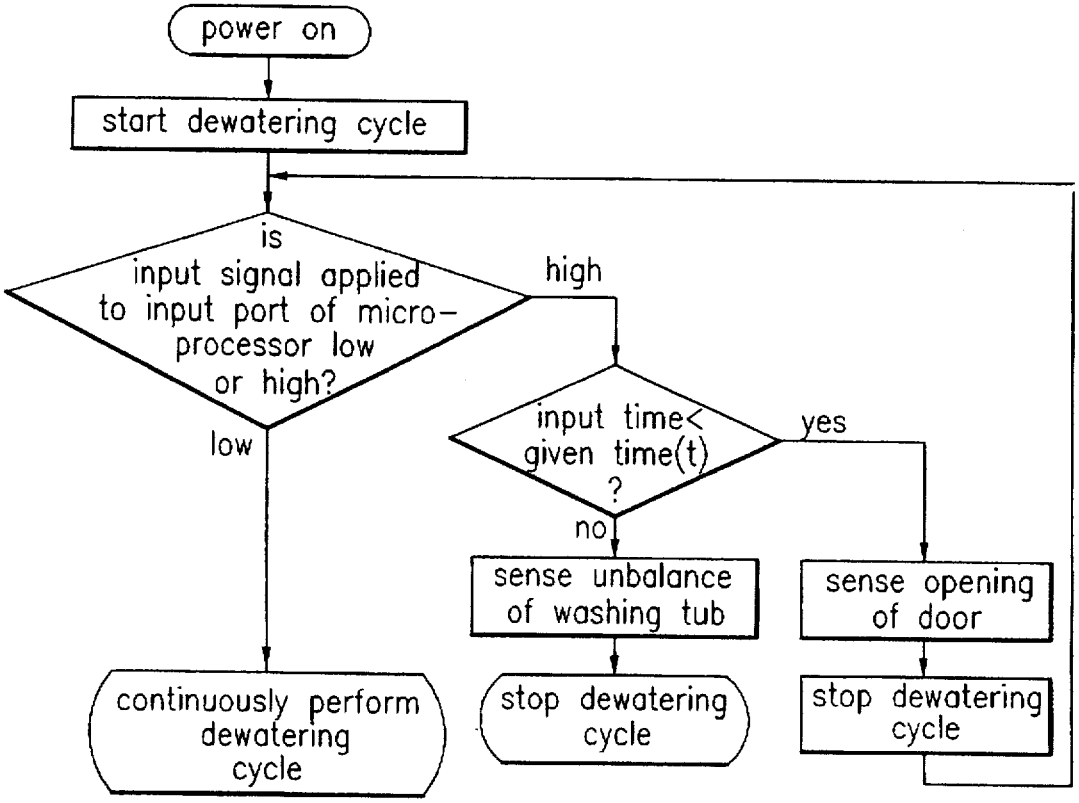
FIG.4 prior art
FIG. 4 is a flow chart showing sensing states of an unbalance of a washing tub and an opening of a door during performing a dewatering function in a conventional automatic washing machine.
Figure 5:
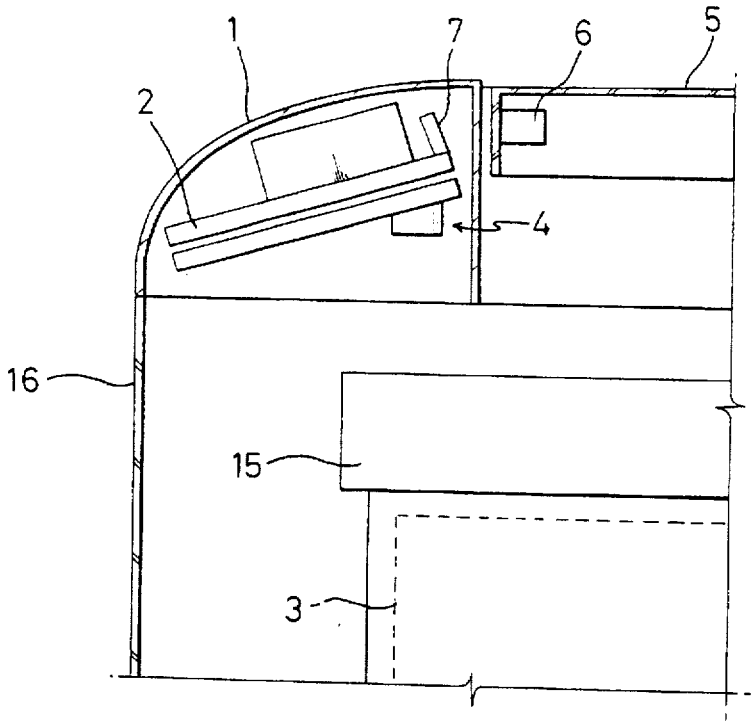
FIG. 5 is a partial sectional view showing a dehydrating apparatus of an automatic washing machine according to the present invention.

Referring to FIG. 5, an unbalance sensor 4 for sensing an unbalance of a washing tub 3 while performing a dewatering function is mounted on a lower portion of a door controller 2 mounted into a top cover 1. A magnet 6 is mounted at the end of a door 5 to sense whether the door 5 is opened during performing the dehydrating function. A hall sensor 7 mounted on door controller 2 adjacent to the magnet 6 senses switching on or off responsive to opening/closing of the door 5 by means of the magnetic field of the magnet 6.

Figure 6:
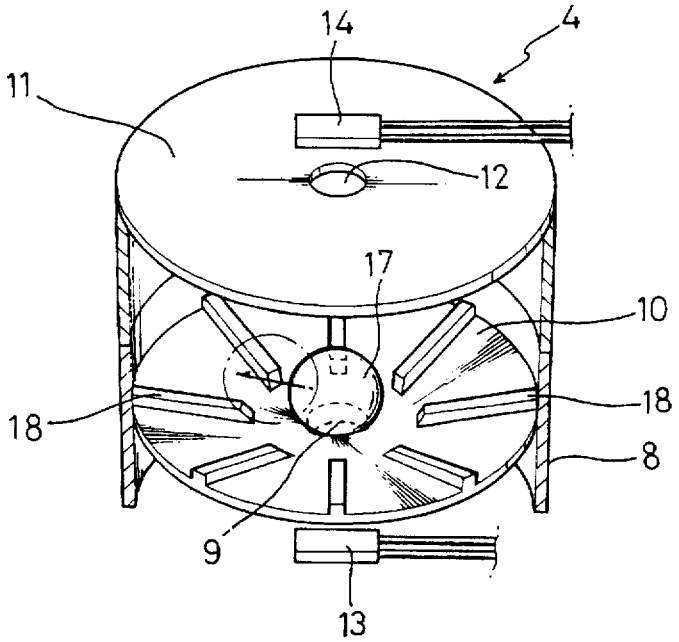
FIG. 6 is a perspective view showing an unbalance sensor of FIG. 5.

Referring to FIG. 6, a signal transmitting hole 9 is formed at the center of a first case 8 in the unbalance sensor 4. A cut-off plate 10 is mounted at a slope of a certain angle to correct a portion which is not horizontal due to a slope of the bottom when the unbalance sensor 4 is mounted. A second case 11 is joined with an upper portion of the first case 8. A signal receiving hole 12 is formed at the center of an upper portion of the second case 11. An infrared ray diode 13 is mounted at a lower portion of the signal transmitting hole 9 so as to emit an infrared beam. A photo transistor 14 is mounted on an upper portion of the signal receiving hole 12 to receive the optical beam. A ball-shaped roller 17 is rolls on an upper portion of the cut-off plate 10, and stops the dewatering cycle by sensing the unbalance of the washing tub 3. The roller 17 is moved by any impact and oscillation occurring when outer tub 15 bumps against body 16 the washing tub 3 leans to one side during the dewatering cycle. As a result of displacement of the roller 17, the beam from infrared ray diode 13 reaches the photo transistor 14 so that the unbalance of the washing tub 3 is sensed. A plurality of roller controlling jaws 18 are formed at peripheral sides on an upper portion of the cut-off plate 10 to prevent the roller 17 from continually rotating and to guide it towards the signal transmitting hole 9 when the outer tub 15 repeatedly bumps against the body 16.

Figure 7:
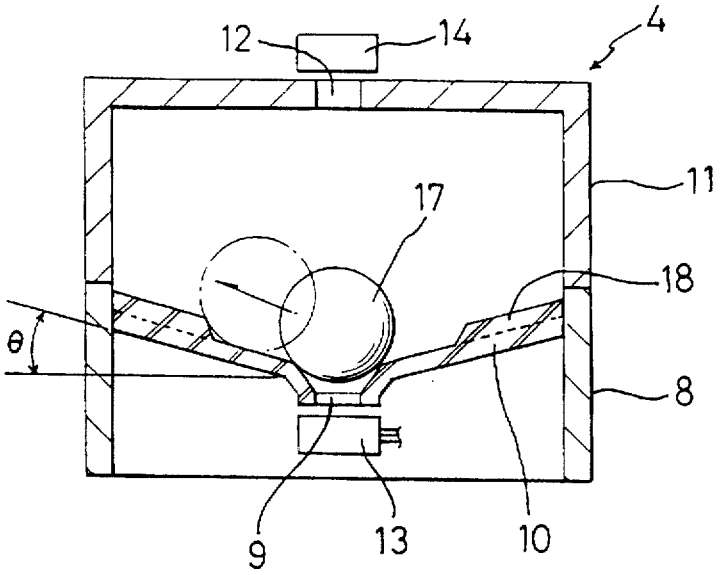
FIG. 7 is a longitudinal sectional view showing an unbalance sensor of FIG. 6.

Referring to FIG. 7, the dehydrating apparatus according to the present invention permits a normal dewatering cycle by preventing the beam emitted from the infrared ray diode 13 from being transmitted to the photo transistor 14 since the roller 17 is disposed on the center of the signal transmitting hole a when the washing tub sits normally during dewatering the dehydrating function. The dewatering cycle is compulsorily stopped by transmitting the beam emitted from the infrared ray diode 13 to the photo transistor 14 when the roller 17 is displaced along the roller controlling jaws 18 when a strong oscillation occurs in the outer tub 15 due to a malfunction of the washing tub during the dewatering cycle.

A plurality of the roller controlling jaws 18 are formed at peripheral sides on the upper portion of the cut-off plate 10 to prevent the roller 17 from excessively rolling along an inner side of the second case 11 when the outer tub 15 successively bumps against the body 16.

Further, the cut-off plate 10 is disposed on the upper portion in the first case 8 at a slope of a certain angle θ(see FIG. 7) based on the signal transmitting hole 9. This allows a portion, which is not horizontal due to a slope of the bottom, to be desirably corrected when the unbalance sensor 4 is mounted into the washing machine or the washing machine is mounted on the bottom with a slope.

The other embodiments of the unbalance sensor according to the present invention will be described with reference to FIGS. 8*a*, 8*b* and 8*c*.

Figure 8A:
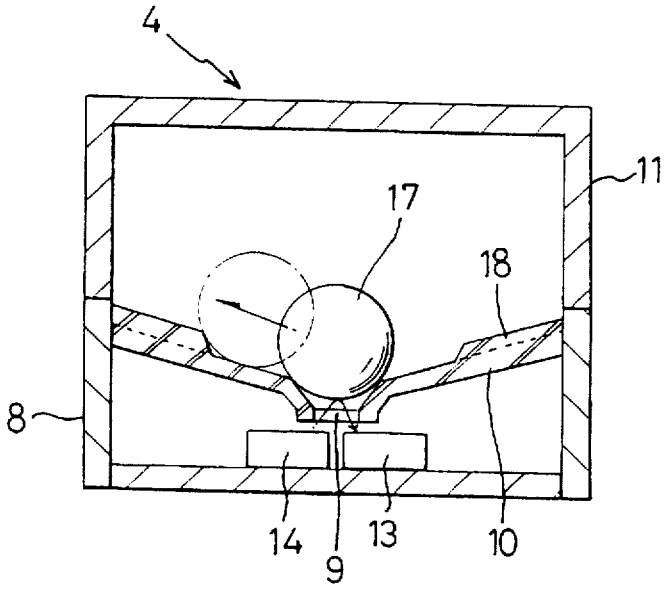
FIGS. 8*a*, 8*b* and 8*c* are longitudinal sectional views showing different embodiments of an unbalance sensor according to the present invention.

Referring to FIG. 8*a*, the infrared ray diode 13 and the photo transistor 14 are mounted adjacent to one another to have a certain angle relative to the lower portion of the hole transmitting signal 9 and the bottom of the first case 8. The optical beam emitted from the infrared ray diode 13 is reflected by the roller 17 to turn on the photo transistor 14 so that the unbalance is sensed during the dewatering cycle.

Figure 8B:
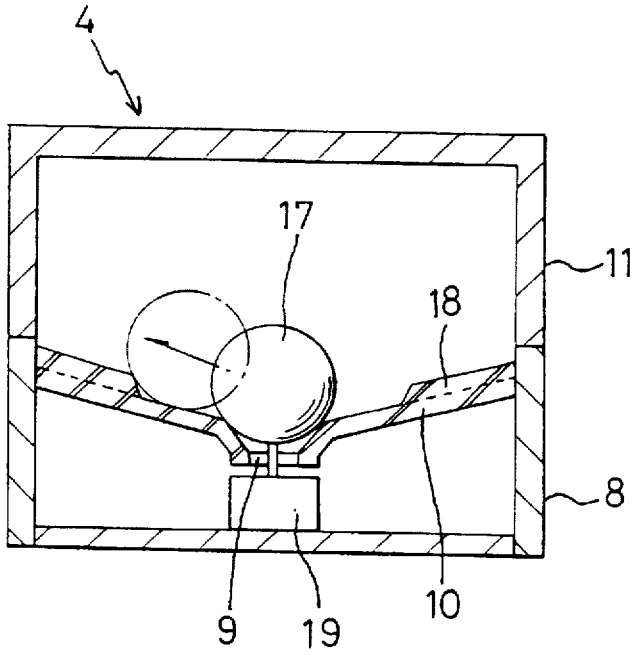

Referring to FIG. 8*b*, a press switch 19 is mounted on the bottom of the first case 14 and the lower portion of the signal transmitting, hole 9 to sense the unbalance in response to a press state by means of the roller's own weight during the dewatering cycle.

Figure 8C:
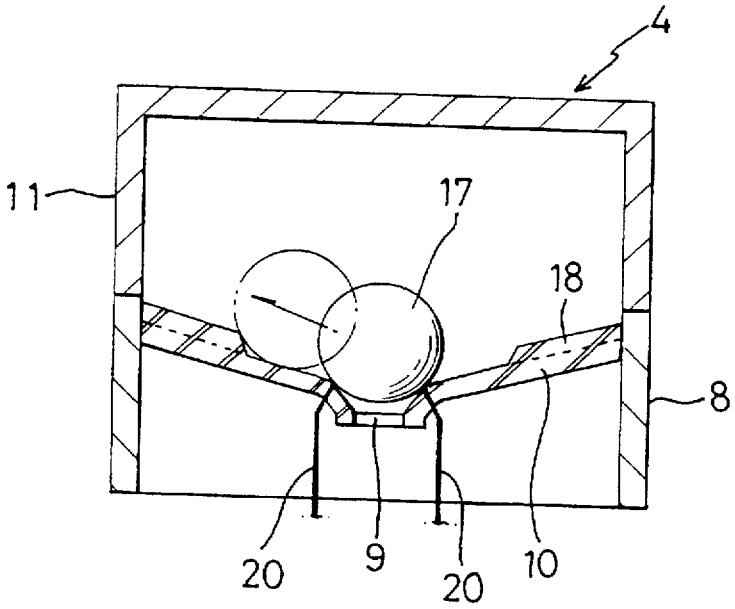

Referring to FIG. 8*c*, switching points 20 are disposed between the bottom of the first case 8 and the cut-off plate 10. The switching points 20 are switched on or off depending on the movement of the roller 17 so that the unbalance is sensed during the dewatering cycle.

To sense the opening of the door 5 during the dewatering cycle, the magnet 6 is mounted at the end of the door 5 and the hall sensor 7 is mounted at the door controller 2 more adjacent to the magnet 6. Thus, the hall sensor 7 is turned on by the magnetic field of the magnet 6 when the door 5 is closed. The hall sensor 7 is turned off when the magnetic field of the magnet 6 does not the hall sensor 7 when the door 5 opens.

A dewatering control circuit used by the dewatering apparatus of the automatic washing machine according to the present invention will be described with reference to FIG. 9 and FIG. 10.

Figure 9:
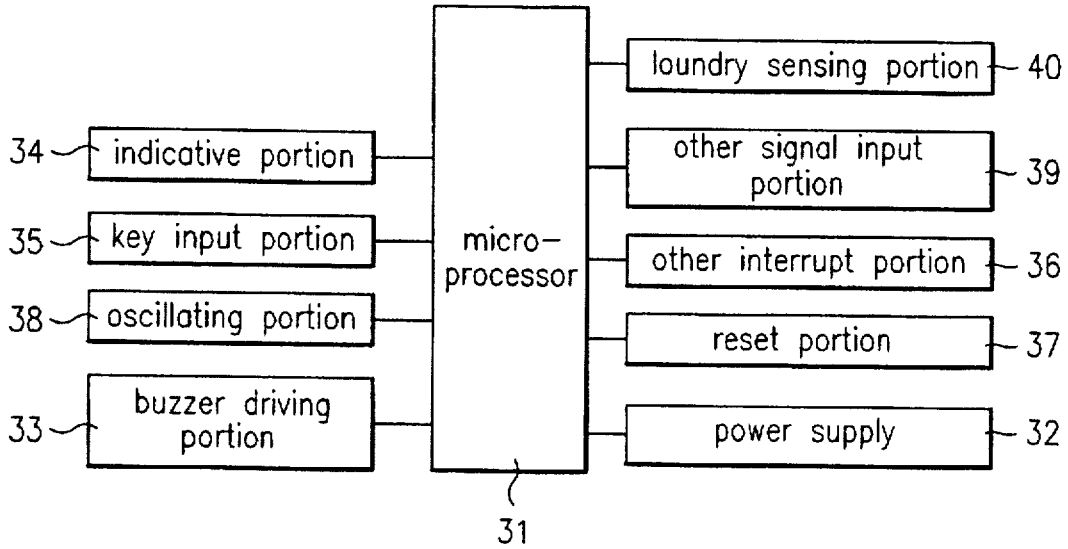
FIG. 9 is an operational system of an automatic washing machine according to the present invention.

Referring to FIG. 9, the dewatering control circuit includes a power supply 32 for supplying the microprocessor and peripheral circuits with power by converting AC 220 V to DC 5 V, a buzzer driving portion 33 indicating an operation state of the washing machine with sound, an indicative portion 34 indicative of the operation state of the washing machine, a key input portion 35 for enabling an appropriate key input, an outer interrupt portion 36 for determining an operation time of the microprocessor 31 in response to frequencies in common use and controlling the other operation time, a reset portion 37 for stabilizing the operation of the microprocessor 31 in the event of power on or off, an oscillating portion 38 for supplying the microprocessor 31 with a clock signal required for its operation, an outer signal input portion 39 for inputting a sensing signal from the unbalance sensor 4 to the microprocessor 31, and a laundry sensing portion 40 for sensing the amount of laundry to determine the amount of water supplied to the washing machine.

Figure 10:
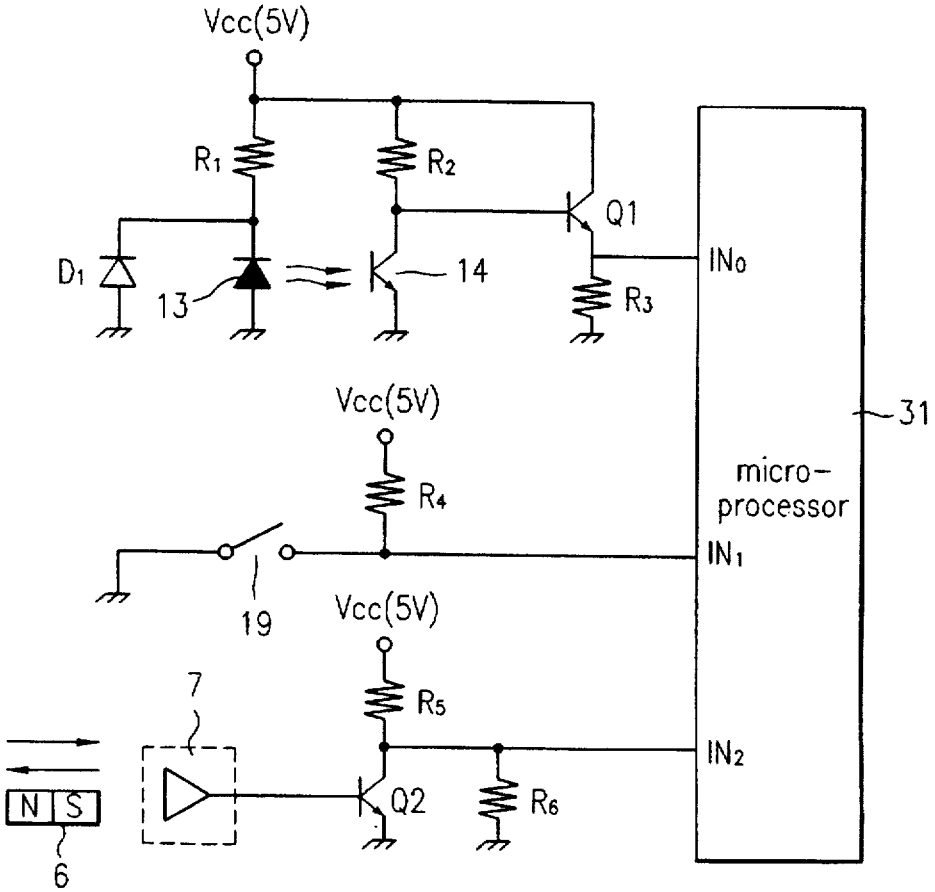
FIG. 10 is a detailed circuit diagram of an outer signal input portion of FIG. 9.

Referring to FIG. 10, the outer signal input portion 39 includes the respective driving circuits having the unbalance sensor 4 connected to a first input port IN0, the press switch connected to a second input port IN1, and the door controller 2 connected to a third input port IN2.

In the driving circuit of the unbalance sensor 4, a power voltage Vcc is applied to the infrared ray diode 13 and the photo transistor 14 through a plurality of resistors R1,R2. Thus, the photo transistor is turned on by the infrared beam emitted from the infrared ray diode 13, so that a signal amplified by the photo transistor 14 is applied to the first input port IN0 of the microprocessor 31 through a first switching transistor Q1. Since the roller 17 prevents the infrared beam emitted from the infrared ray diode 13 from being transmitted to the photo transistor 14 by blocking the signal transmitting hole on the center of the cut-off plate 10 during a normal dewatering cycle as shown in FIG. 6, the photo transistor 14 is turned off and, at the same time, a first switching transistor Q1 is turned off. As a result, a low signal is applied to the first input port IN0 of the microprocessor 31.

On the contrary, when the roller 17 is moved from the signal transmitting hall 9 when unbalance occurs during the dewatering cycle, the infrared beam emitted from the infrared ray diode 13 is transmitted to the photo transistor 14. Thus, the photo transistor 14 is turned on so that the power voltage Vcc flows through the resistor R2 and the photo transistor 14, and a low voltage is applied to the base of the first switching transistor Q1, turning on the first switching transistor Q1. As a result, a high voltage of 5V is applied to the microprocessor 31.

Since the power voltage Vcc flows through a resistor R4 and the ground of one switching point of the press switch 19 the press switch 19 is switched on a low voltage is applied to the microprocessor 31. On the other hand, a high voltage level is applied to the second input port IN1 of the microprocessor 31 through the resistor R4 when the press switch 19 is open (i.e., off).

Meanwhile, the hall sensor 7 is turned on by the magnetic field of the magnet 6 when the magnet 6, mounted at the end of the door 5, is adjacent to the hall sensor 7. Thus, the second switching transistor Q2 is turned on and the power voltage Vcc flows to the ground through a resistor R5 so that a low voltage level is applied to the third input port IN3 of the microprocessor 31.

On the contrary, when the magnet 6 is away from the hall sensor 7, (i.e. the door 5 is open), the hall sensor 7 is turned off and the second switching transistor Q2 is also turned off. As a result, a high voltage level applied to the third input port IN3 of the microprocessor 31.

Figure 11:
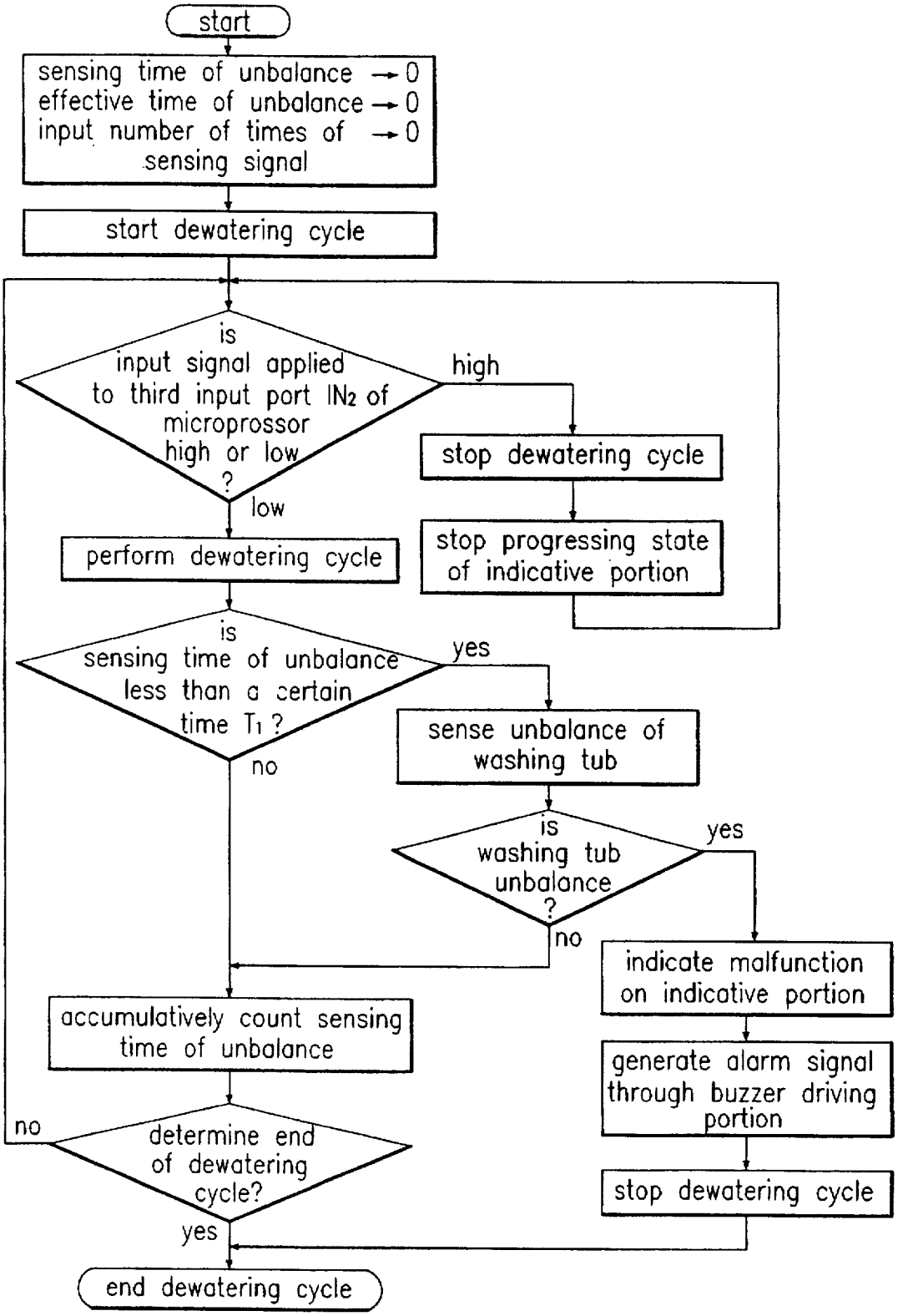
FIG. 11 is a flow chart illustrating a dewatering control method of an automatic washing machine according to the present invention.
Figure 12:
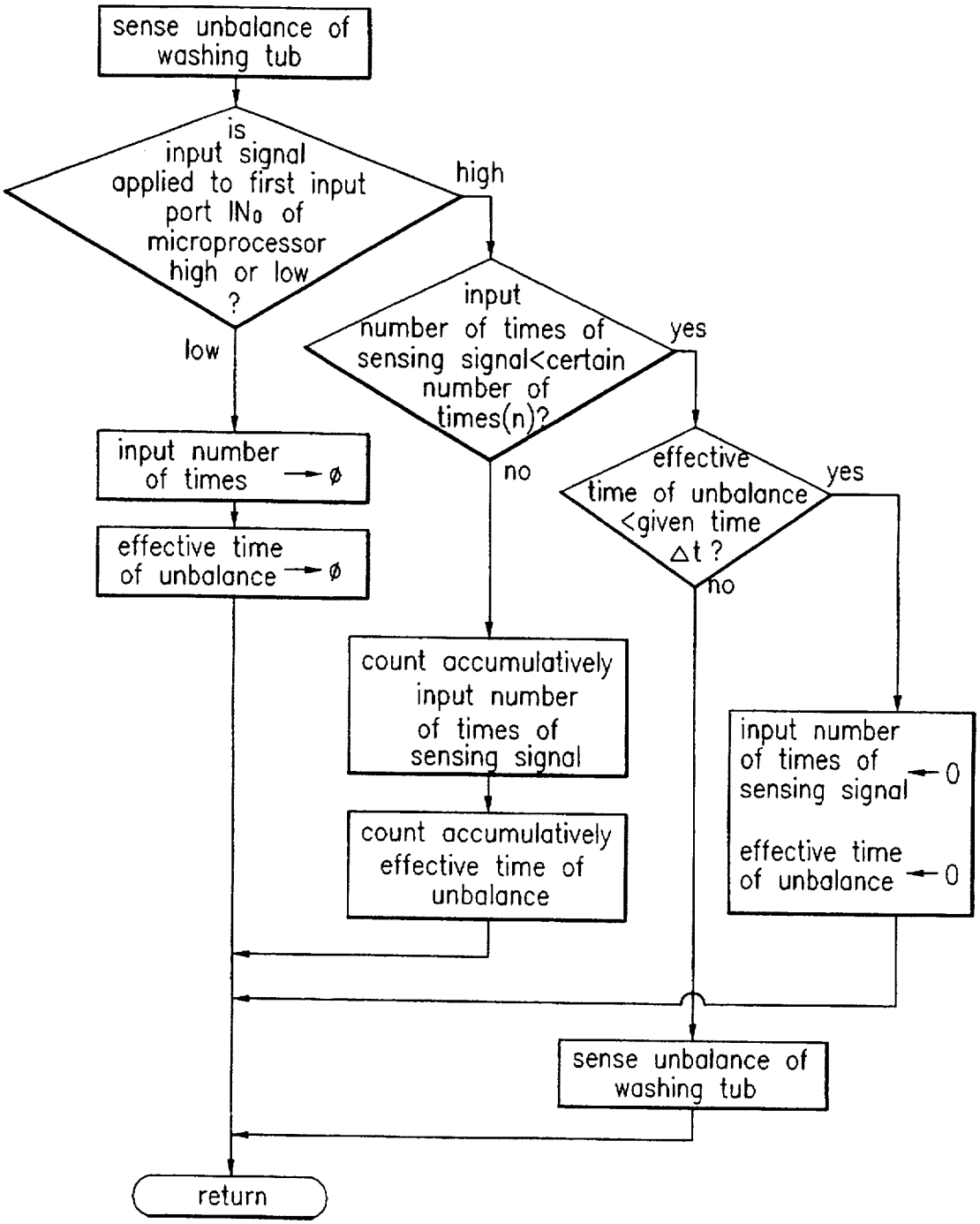
FIG. 12 is a flow chart illustrating an unbalance sensing operation of a washing tub of FIG. 11.

FIG. 11 is a flow chart illustrating a dewatering control method of an automatic washing machine according to the present invention. FIG. 12 is a flow chart illustrating an unbalance sensing operation of a washing tub of FIG. 11.

The dewatering control method of the automatic washing machine according to the present invention will be described with reference to FIG. 11.

First, once the dewatering cycle progresses after washing and rinse of laundry, a variable state of the microprocessor 31 relating to the dewatering function is initiated.

Then, a level of an input signal input to the third input port IN3 of the microprocessor 31 is determined. When the input signal is high, the dewatering cycle is stopped according to whether opening the door 5 is open or not. At the same time, a progressing state of the indicating the process portion indicative of the dewatering cycle in progress is stopped. Such steps repeat until a low signal is input to the third input port IN3 of the microprocessor 31. If the input signal is low, the dewatering cycle continues.

Subsequently, sensing time of the unbalance is counted from the starting time of the dewatering function to sense the unbalance of the washing tub for a certain time T1 since the dewatering function has progressed. The sensing time is then compared with a certain time T1. A sub-routine for sensing the unbalance of the washing tub is performed if the sensing time of the unbalance is less than time T1. The dewatering cycle ends by accumulatively counting the sensing time of the unbalance, storing it into a memory, and determining whether or not the end of the dewatering cycle, if not.

The sensing an unbalance of the washing tub according to the sub-routine will be described with reference to FIG. 12.

An effective time of the unbalance and the input number of times of the sensing signal are initiated respectively upon determining a normal dewatering cycle if the low signal is applied to the first input port IN0 of the microprocessor 31. Then, the step of accumulatively counting the sensing time of the unbalance returns. The input number of times of the sensing signal and the effective time of the unbalance are accumulatively counted until a certain number of times n of the sensing signal by counting the input number of times of the sensing signal if the input signal is high. Then, the step of accumulatively counting the sensing time of the unbalance returns after storing them into a memory of the microprocessor 31. The input number of times of the sensing signal responsive to the effective time is stored into the memory by counting the effective time of the unbalance from the initial input signal.

When a number of times that the unbalance sensing signal is input is as much as a certain number of times n, it is determined as the effective unbalance sensing signal. When the effective unbalance sensing signal from the initial unbalance sensing signal is input in a given time Δt, the unbalance of the washing tub is sensed. When the effective time of the unbalance is more than a given time Δt, the input number of times of the sensing signal and the effective time of the unbalance are initiated to determine an outer noise signal. Then, the step of accumulatively counting the sensing time of the unbalance returns.

That is, the unbalance of the washing tub is sensed in case where the input number of times n of the sensing signal is input to the microprocessor 31 in a given time Δt. Thereafter, the subroutine for sensing the unbalance is performed as shown in FIG. 11. After performing the sub-routine, the unbalance of the washing tub is determined. When the washing tub is not unbalanced, the sensing time of the unbalance is counted and stored into the memory. Then, the dewatering function continues until the end time of the dewatering cycle. When the washing tub is unbalanced, the indicative portion indicates the malfunction of the washing tub and at the same time the buzzer driving portion generates an alarm signal to stop the dewatering cycle.

The dewatering apparatus of the automatic washing machine and the control method thereof according to the present invention as aforementioned has the following effects.

First, since it is easy to exactly sense the unbalance of the washing tub and the opening of the door due to the dehydrating cycle when laundry in the washing tub leans to one side, it allows a normal dewatering cycle to progress by controlling the respective portions to perform their own normal functions.

Second, it reduces manufacturing costs as well as the space required for mounting the dewatering apparatus according to simplification of the dewatering control apparatus. It also makes the washing machine compact overall.

Finally, efficiency and reliability of the washing machine can be improved by an exact control of the dewatering cycle.

It will be apparent to those skilled in the art that various modifications and variations can be made in the unbalance sensor and opening/closing sensor of the door according to the control method of the dewatering apparatus of the present invention without departing from the spirit or scope of the invention. Thus, it is intended that the present invention cover the modifications and variations of the invention provided they come within the scope of the appended claims and their equivalents.

What is claimed is:

1. A method for controlling a dewatering cycle in an automatic washing machine, comprising the steps of:

initiating a variable state relating to the dewatering function and determining levels of input signals input to input ports of a microprocessor;

stopping the dewatering cycle in progress by determining as an opening of a door in the input signals of the microprocessor are high and, at the same time, stopping a progressing state of an indicative portion indicative of the dewatering cycle in progress;

progressing the dewatering cycle if the input signals are low;

counting sensing time of an unbalance from starting time of the dewatering function to sense the unbalance of the washing tub for a certain time since the dewatering function has progressed, and comparing and determining if it is less than a certain time; and performing a sub-routine which senses the unbalance of the washing tub when the sensing time of the unbalance is less than a certain time, and determining progressing time of the dewatering cycle after accumulatively counting the sensing time of the unbalance and storing it into a memory when it is greater than a certain time.

2. The according to claim 1, further comprising a step of performing the dewatering function up to end time of the dewatering cycle by accumulatively counting the sensing time of the unbalance in case where the washing tub is not unbalanced upon performing the sub-routine.

3. The method according to claim 2, further comprising the steps of indicating a malfunction of the dewatering cycle on the indicative portion, at the same time, generating an alarm signal through a buzzer driving portion, and stopping the dewatering cycle, when the washing tub is unbalanced upon performing the sub-routine.

4. The method according to claim 1, wherein the unbalance of the washing tub is sensed in the event of an input number of times of sensing signals inputting to the microprocessor in a given time to thereby return to the sub-routine.

5. The method according to claim 4, wherein the sub-routine which senses the unbalance of the washing tub comprises the steps of initiating an effective time of the unbalance and the input number of times of the sensing signal in case where an input signal applied to a first input signal applied to a first input port of the microprocessor is low and returning the step of accumulatively counting the sensing time of the unbalance.

6. The method according to claim 5, wherein the sub-routine further comprises the step of determining whether or not the input number of times of the sensing signals is less than a certain number of times n in case where an input signal applied to the first input port of the microprocessor is high.

7. The method according to claim 6, wherein the sub-routine further comprises the steps of storing the input number of times of the sensing signals and an effective time of the unbalance into a memory by accumulatively counting them in case where the input number of times of the sensing signals is more than a certain number of times n, and returning the step of accumulatively counting the sensing time of the unbalance.

8. The method according to claim 6, wherein the sub-routine further comprises the step of determining whether or not an effective time of the unbalance of the washing tub is less than a given time Δt in case where the input number of times of the sensing signals is less than a certain number of times n.

9. The method according to claim 8, wherein the sub-routine further comprises the steps of returning after sensing the unbalance of the washing tub in case where an effective time of the unbalance of the washing tub is less than a given time Δt, and returning the step of accumulatively counting the sensing time of the unbalance.

10. The method according to claim 9, wherein the sub-routine further comprises the step of initiating the input number of times of the sensing signals and an effective time of the unbalance in case where an effective time of the unbalance is more than a given time Δt.

* * * * *